US008882162B2

(12) United States Patent
Uyeda

(10) Patent No.: US 8,882,162 B2
(45) Date of Patent: Nov. 11, 2014

(54) MULTIPLE POINT DOOR LOCKING SYSTEM, WITH HANDLE TURNING DIRECTION CONTROL

(75) Inventor: Alan K. Uyeda, Irvine, CA (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 0 days.

(21) Appl. No.: 13/317,050

(22) Filed: Oct. 11, 2011

(65) Prior Publication Data

US 2012/0025544 A1 Feb. 2, 2012

Related U.S. Application Data

(63) Continuation of application No. 12/384,948, filed on Apr. 10, 2009, now abandoned, which is a continuation-in-part of application No. 12/383,140, filed on Mar. 20, 2009.

(51) Int. Cl.

| | |
|---|---|
| ***E05B 3/00*** | (2006.01) |
| ***E05B 59/00*** | (2006.01) |
| *E05B 63/00* | (2006.01) |
| *E05B 65/10* | (2006.01) |
| *E05B 63/18* | (2006.01) |
| *E05B 1/00* | (2006.01) |

(52) U.S. Cl.

CPC ..... *E05B 59/00* (2013.01); *E05B 63/0065* (2013.01); *E05B 65/1086* (2013.01); *E05B 63/18* (2013.01); *E05B 2001/0076* (2013.01)

USPC ..... 292/336.3; 292/7; 292/32; 292/34; 292/39; 292/172; 70/91; 70/107; 70/472

(58) Field of Classification Search

USPC ..... 292/22, 39, 160, 172, 142

See application file for complete search history.

(56) References Cited

U.S. PATENT DOCUMENTS

| | | | |
|---|---|---|---|
| 3,640,560 | A | 2/1972 | Zawadzki et al. |
| 3,672,714 | A | 6/1972 | Schultz |

(Continued)

FOREIGN PATENT DOCUMENTS

| | | | |
|---|---|---|---|
| CN | 1592812 | A | 3/2005 |
| CN | 1749515 | A | 3/2006 |

(Continued)

OTHER PUBLICATIONS

State Intellectual Property Office of the People's Republic of China, "Search Report," for Chinese application 201080019420.4, dated Aug. 5, 2013, Beijing, China.

(Continued)

*Primary Examiner* — Kristina Fulton
*Assistant Examiner* — Thomas Neubauer
(74) *Attorney, Agent, or Firm* — Woods Oviatt Gilman LLP; Ronald J. Kisicki, Esq.

(57) ABSTRACT

A locking system enabling selective handle turning direction to operate an unlocking mechanism is provided. The system comprises a handle, a gear rack driven linearly by rotation of the handle, and a plate removably coupled to the gear rack by a coupling means, wherein the plate moves in a first linear direction in response to handle rotation. When the coupling means is in a first position to couple the plate to the gear rack, a clockwise rotation of the handle displaces the plate in the first linear direction. When the coupling means is in a second position to couple the plate to the gear rack, a counter-clockwise rotation of the handle displaces the plate in the first linear direction. Movement of the plate in the first direction operates the unlocking mechanism.

9 Claims, 10 Drawing Sheets

(56) References Cited

U.S. PATENT DOCUMENTS

| | | | | |
|---|---|---|---|---|
| 4,429,556 | A | 2/1984 | Kambic | |
| 4,643,007 | A | 2/1987 | Fish et al. | |
| 4,809,526 | A * | 3/1989 | Shen | 70/107 |
| 4,838,053 | A | 6/1989 | Shen | |
| 4,934,800 | A * | 6/1990 | Choi | 292/172 |
| 5,042,316 | A | 8/1991 | Gressett, Jr. | |
| 5,076,625 | A | 12/1991 | Oxley | |
| 5,077,992 | A | 1/1992 | Su | |
| 5,118,150 | A | 6/1992 | Jarrett | |
| 5,184,523 | A | 2/1993 | Nyzedatny | |
| 5,265,920 | A | 11/1993 | Kaup et al. | |
| 5,433,495 | A | 7/1995 | Uffner | |
| 5,482,334 | A | 1/1996 | Hotzl | |
| 5,490,699 | A | 2/1996 | Uyeda | |
| 5,509,703 | A * | 4/1996 | Lau et al. | 292/1 |
| 5,513,505 | A | 5/1996 | Dancs | |
| 5,513,510 | A * | 5/1996 | Solovieff et al. | 70/472 |
| 5,524,941 | A * | 6/1996 | Fleming | 292/34 |
| 5,765,410 | A | 6/1998 | Kwan et al. | |
| 6,023,952 | A | 2/2000 | Mantarakis et al. | |
| 6,125,670 | A | 10/2000 | Fuss et al. | |
| 6,170,305 | B1 | 1/2001 | Shen | |
| 6,178,795 | B1 * | 1/2001 | Hsueh | 70/472 |
| 6,257,030 | B1 * | 7/2001 | Davis et al. | 70/107 |
| 6,302,456 | B1 | 10/2001 | Errani | |
| 6,324,876 | B1 | 12/2001 | Prevot et al. | |
| 6,328,357 | B1 * | 12/2001 | Overbey et al. | 292/336.3 |
| 6,334,636 | B1 * | 1/2002 | Huang et al. | 292/144 |
| 6,485,067 | B1 * | 11/2002 | Root | 292/142 |
| 6,581,423 | B2 | 6/2003 | Lin | |
| 6,813,915 | B2 | 11/2004 | Chang | |
| 6,851,287 | B1 | 2/2005 | Yang et al. | |
| 6,871,884 | B2 * | 3/2005 | Hoffmann et al. | 292/39 |
| 6,993,946 | B1 | 2/2006 | Shen | |
| 6,994,383 | B2 * | 2/2006 | Morris | 292/160 |
| 7,013,688 | B2 | 3/2006 | Chen | |
| 7,101,195 | B2 | 9/2006 | Brooks | |
| 7,257,973 | B2 | 8/2007 | Romero et al. | |
| 7,303,215 | B2 | 12/2007 | Moon et al. | |
| 7,353,674 | B2 | 4/2008 | Raatikainen et al. | |
| 7,363,784 | B2 | 4/2008 | Schvarts | |
| 7,431,354 | B2 | 10/2008 | Raatikainen | |
| 7,661,279 | B2 | 2/2010 | Huang et al. | |
| 7,677,067 | B2 | 3/2010 | Riznik et al. | |
| 7,712,343 | B2 | 5/2010 | Smith et al. | |
| 8,419,084 | B2 | 4/2013 | Ding et al. | |
| 8,491,019 | B2 * | 7/2013 | Uyeda | 292/172 |
| 2001/0005084 | A1 | 6/2001 | Ponziani | |
| 2003/0019256 | A1 | 1/2003 | Frolov | |
| 2003/0199223 | A1 | 10/2003 | Spurr | |
| 2004/0194519 | A1 | 10/2004 | Chen | |
| 2004/0239121 | A1 * | 12/2004 | Morris | 292/39 |
| 2006/0123859 | A1 | 6/2006 | Gonzalez | |
| 2006/0191303 | A1 * | 8/2006 | Shvarts | 70/107 |
| 2007/0051143 | A1 | 3/2007 | Raatikainen et al. | |
| 2007/0096475 | A1 | 5/2007 | Raatikainen | |
| 2007/0113603 | A1 | 5/2007 | Polster | |
| 2007/0266747 | A1 | 11/2007 | Rafferty et al. | |
| 2008/0156048 | A1 | 7/2008 | Topfer | |
| 2009/0267358 | A1 * | 10/2009 | Bourgain et al. | 292/160 |
| 2009/0308112 | A1 * | 12/2009 | Uyeda | 70/91 |
| 2011/0252709 | A1 * | 10/2011 | Uyeda | 49/503 |

FOREIGN PATENT DOCUMENTS

| | | |
|---|---|---|
| TW | 453386 U | 9/2001 |
| TW | I225117 | 12/2004 |
| TW | M341085 | 9/2008 |
| WO | 2004092513 A2 | 10/2004 |

OTHER PUBLICATIONS

TW Patent Office, Office Action, Feb. 21, 2014.

* cited by examiner

FIG. 5
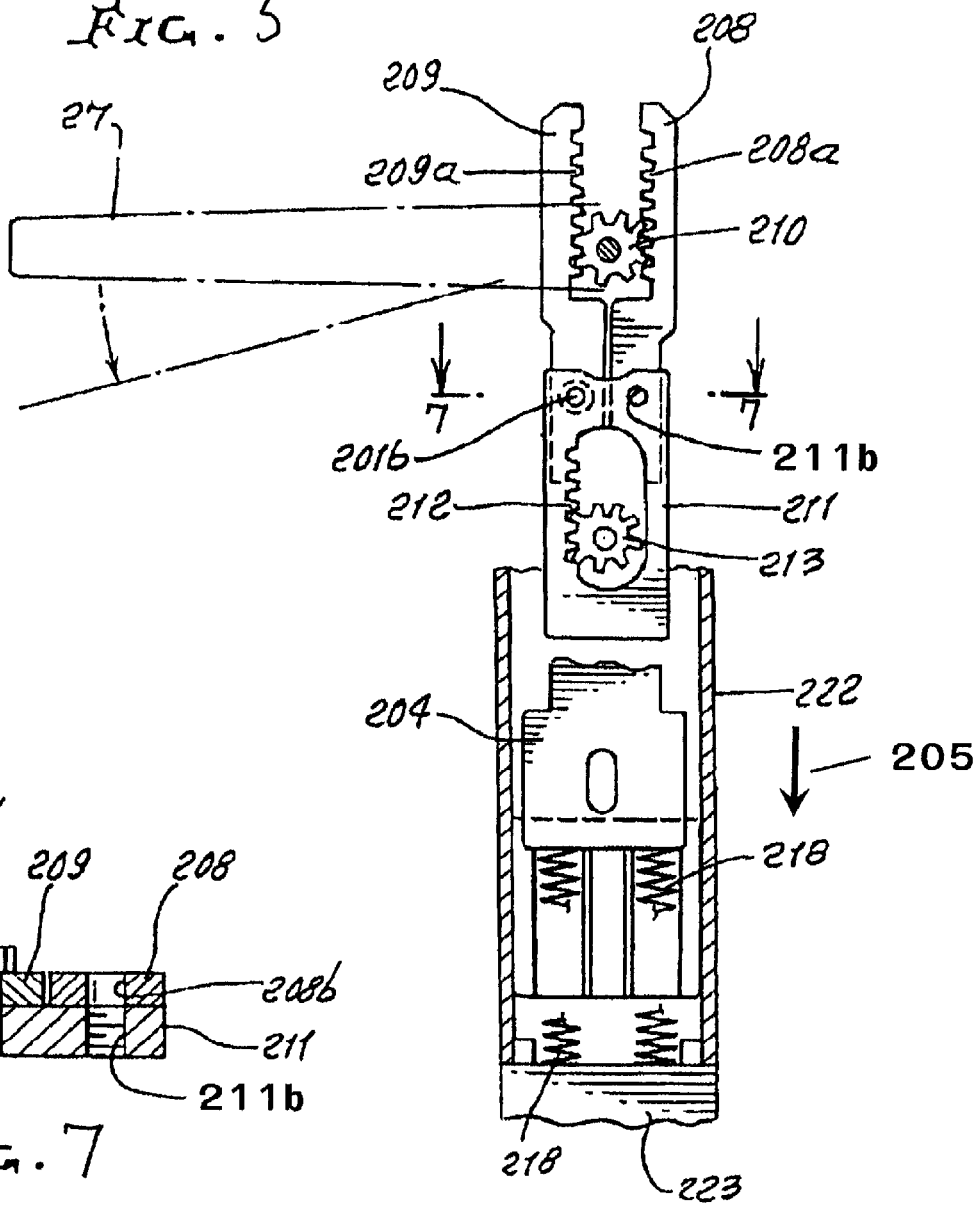
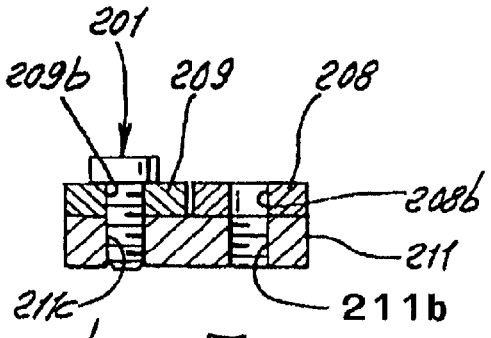
FIG. 7

MULTIPLE POINT DOOR LOCKING SYSTEM, WITH HANDLE TURNING DIRECTION CONTROL

This application in a continuation of U.S. application Ser. No. 12/384,948, filed Apr. 10, 2009, now abandoned entitled MULTIPLE POINT DOOR LOCKING SYSTEM, WITH HANDLE TURNING DIRECTION CONTROL, which is a continuation-in-part of Ser. No. 12/383,140, filed Mar. 20, 2009, and entitled "MULTIPLE POINT DOOR LOCKING SYSTEM", which is incorporated herein by reference.

BACKGROUND OF THE INVENTION

There is need for simple, highly compact, durable and efficient door locking and unlocking devices, where deadbolts and latches are to be operated, as from the inner and outer sides of doors. In particular, there is need for improvements in mechanism responsive to door handle turning, and incorporating means enabling handle positioning for selective handed turning, clockwise or counterclockwise. One example enables selected direction handle turning at the door inner side, with mechanism responsive to door unlocking at the door inner side, to secure door unlatching.

SUMMARY OF THE INVENTION

It is a major object of the invention to provide improvements in apparatus meeting the above needs.

Basically, a locking system enabling selectively handed (right or left) handle turning, incorporating the invention, includes:

a) drive means including the handle rotatable clockwise and counterclockwise, b) driven means including a part movable linearly in a primary direction, to operate door lock structure, c) and coupling means including a handle rotation direction selector having first and second alternate positions, and operable to displace said part in said primary direction in response to handle clockwise rotation when the selector is in first position, and alternatively to displace that part in the primary direction in response to handle counterclockwise rotation, when the selector is in second position.

As will be seen, such structure and functioning enables or facilitates door installation and operation for unlocking operation, by turning to handle either clockwise or counterclockwise, with the basic mechanism of the lock structure remaining unchanged.

Another object includes provision of such coupling to include two coupling racks, one of which is operatively coupled to the driven part when the handle is rotated clockwise, and the other of which is operatively coupled to the driven part when the handle is rotated counterclockwise. As will be seen, the selector is alternatively coupled to one or the other of two coupling racks, characterized in that the non-coupled rack remains inactive when the coupled rack is displaced in said direction in response to handle rotation, for either direction of such rotation.

A further object includes provision of the driven means to include a linearly movable lock actuating member to which one or the other of the racks is coupled by the selector. As will be seen, the selector may comprise a connector such as a pin, easily shifted between alternate positions of rack coupling to the lock actuating member, as at the time of lock system installation. The uncoupled rack typically "floats" inactively during coupled rack displacement. Yet another object includes provision of such racks to be separately movable in parallel relation, at opposite sides of a rack engaging gear driven by handle rotation.

An additional object includes provision of the selector in the form of a connector shiftable between alternate positions of rack coupling to the lock actuating member, as at the time of lock system installation.

Yet another object includes provision of the lock actuating member in the form of a linearly movable plate incorporating a further rack operatively coupled to a driven gear that operates door locking and unlocking mechanism. The two coupling racks, the further rack, and the plate are typically longitudinally vertically oriented for movement longitudinally, in compact, efficient aligned relation, for door mounting. Return springs serve to urge the plate and its driving rack upwardly.

In accordance with a further aspect of the invention, the structure as referred to, may be efficiently incorporated in a multi-function door lock system comprising:

a) a frame having opposite sides, and installable on a door openable between an interior space and an exterior space, b) a deadbolt and a door latch carried by the frame to move between retractable and extended positions, c) a first rotary control located at one level on the frame to control deadbolt movement between extended and retracted positions via primary cam mechanism, d) a second rotary control, operated by the handle or handles, at another level on the frame to control latch movement between extended and retracted positions, via secondary cam mechanism, e) means operatively connected between the secondary cam mechanism and the primary cam mechanism to effect deadbolt movement as aforesaid, in response to operation of the second rotary control, as effected via rotary input to the second rotary control from only one side of the frame.

In this regards, objectives and structure defined in said Ser. No. 12/383,140, are incorporated herein by reference.

These and other objects and advantages of the invention, as well as the details of an illustrative embodiment, will be more fully understood from the following specification and drawings, in which:

DRAWING DESCRIPTION

FIG. 5 is a view like FIG. 3, with the door handle turnable counterclockwise to activate the other of the two parallel racks;

FIG. 7 is a section taken on lines 7-7 of FIG. 5;

DETAILED DESCRIPTION

Figure 4:
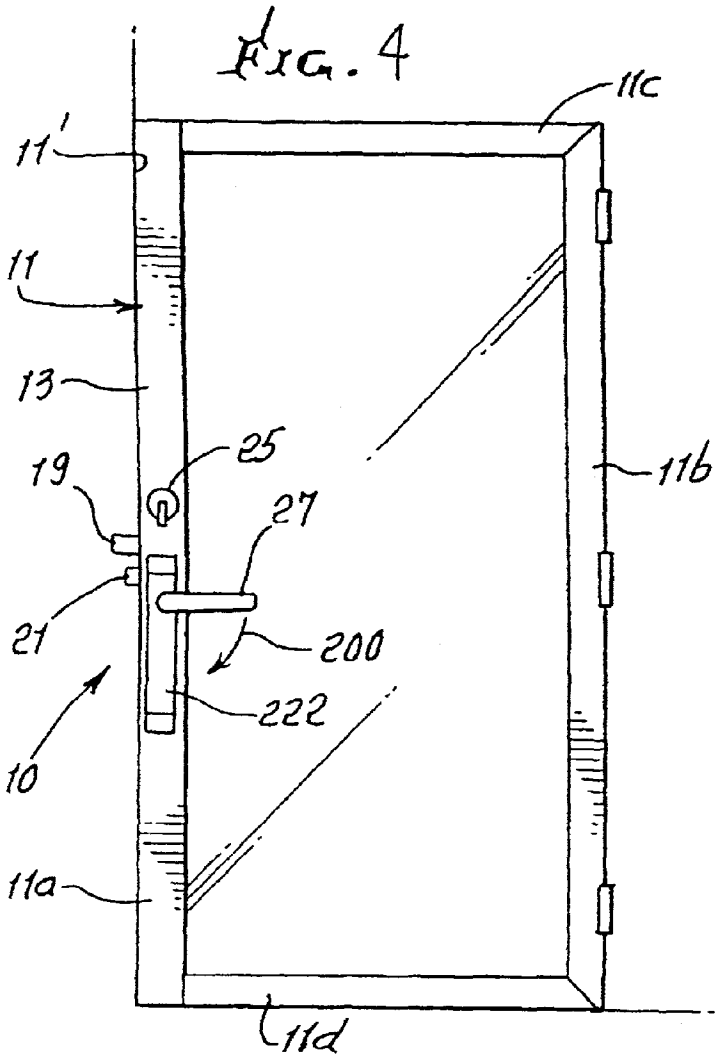
FIG. 4 shows the handle of FIG. 1 in relation to a door installation.

In FIG. 4, a preferred multi-function door lock system 10, has a mounting frame 11 sized for insertion into a door opening 11'.

Figure 8:
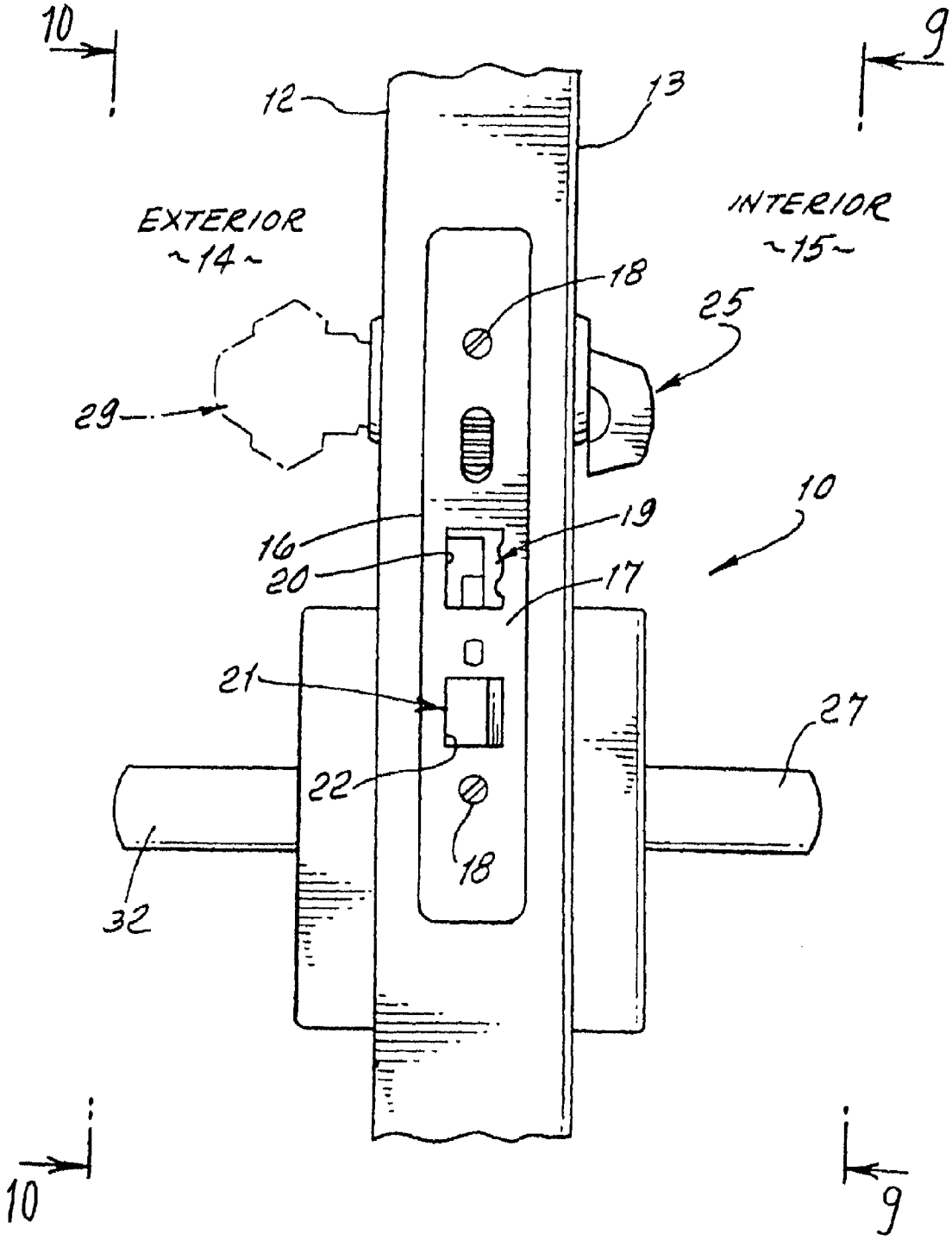
FIG. 8 is an elevation showing a door edge with two inputs (latch key and handle) from the door extension side, and two inputs (finger and thumb, knob and door handle) from the door interior side.
Figure 9:
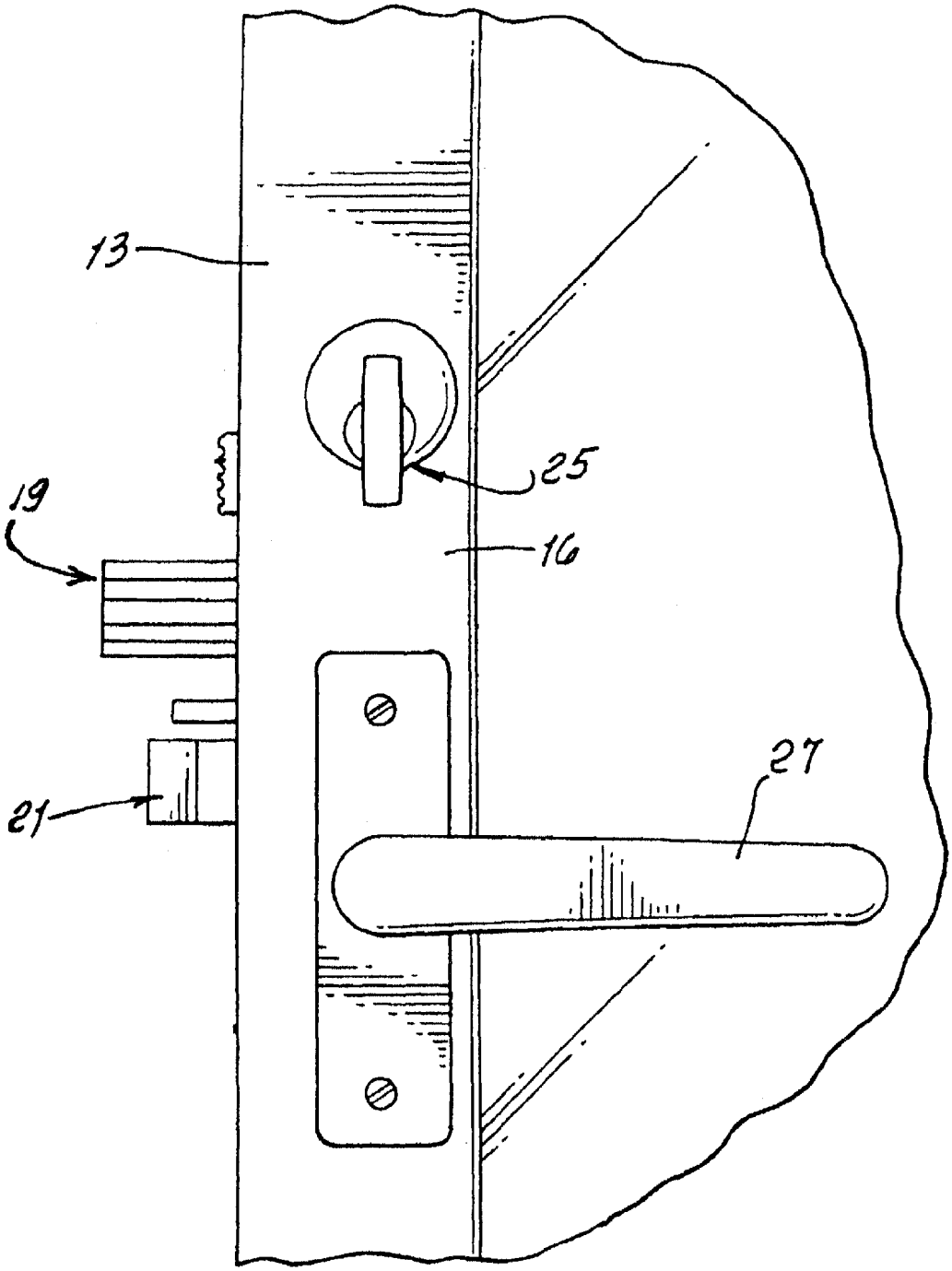
FIG. 9 is an elevation taken on lines 9-9 of FIG. 8.

As best seen in FIG. 8, the frame has opposite sides 12 and 13 which respectively face toward the door exterior 14, and the door exterior 15, and the door interior. The front side 16 of the frame is carried by a mounting plate 17 held in position by fasteners 18, as seen in FIG. 8. As seen in FIGS. 4 and 9, a deadbolt 19 is carried by the frame to protrude from the plate 17, via opening 20, as the bolt is moved between extended position and retracted position in the frame; and a latch bolt 21 is carried by the frame below 19, to protrude from plate 17 via opening 22, as it is moved between extended position and retracted position in the frame.

As best seen in FIGS. 8 and 9, first rotary control such as rotary actuator 25 is located at one level on the frame, at the interior side of the door, for example, to control deadbolt movement between extended and retracted positions via compact mechanism in the frame. Actuator 25 is typically gripped by the user's thumb and finger, to be turned in operating the deadbolt. A second rotary control, such as handle 27 is located at a second and typically lower level, to project from the frame, at the interior side of the door, for example, to control latch 21 movement between extended and retracted positions via compact mechanism in the frame, that mechanism typically including a secondary cam mechanism.

Figure 10:
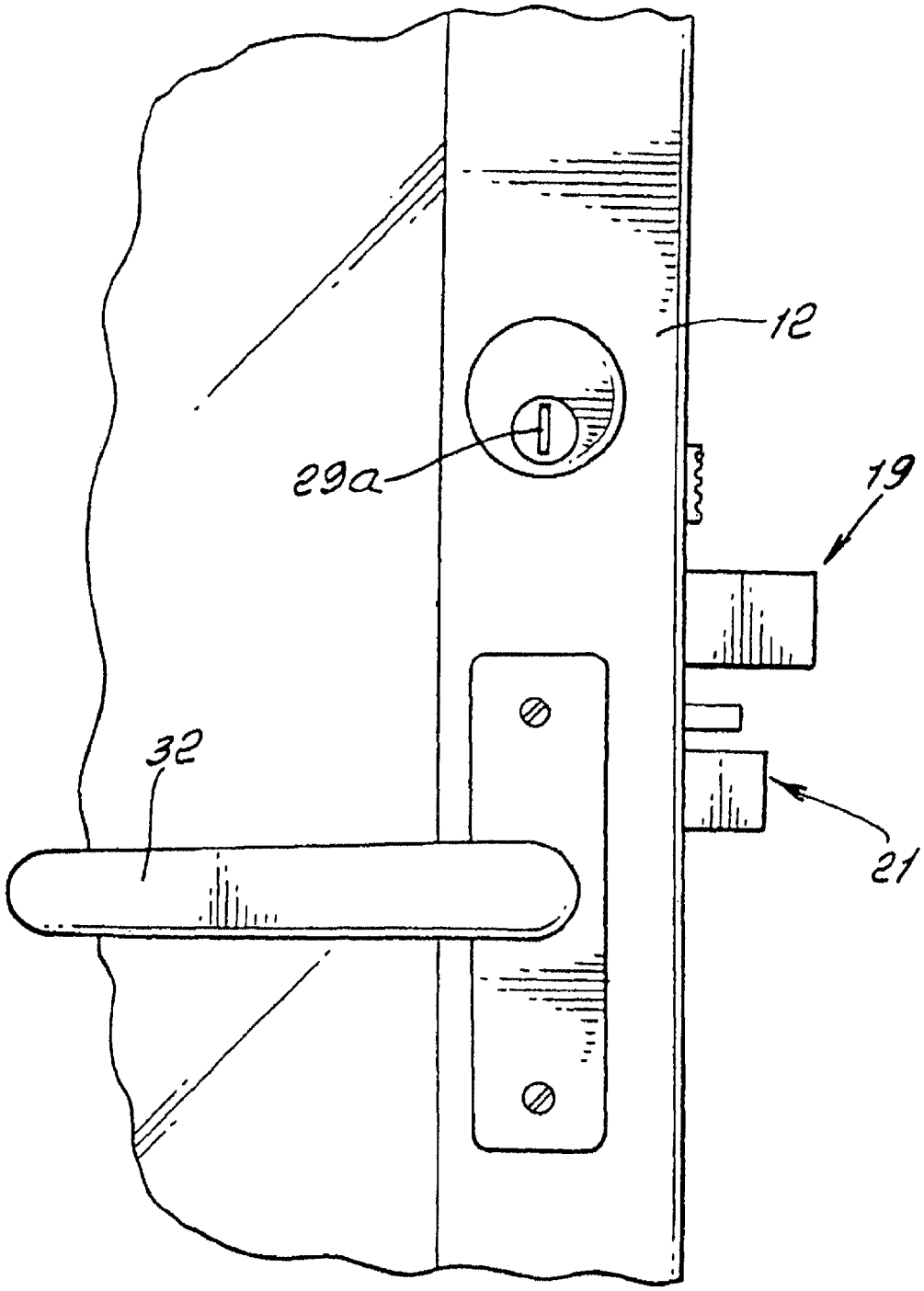
FIG. 10 is an elevation taken on lines 10-10 of FIG. 8.

FIG. 8 also shows a key 29 projecting or inserted via keyhole 29*a* (FIG. 10) at the exterior side of the door, i.e. opposite from rotary actuator 25, to be operatively connected with the first rotary control for moving the deadbolt (as between extended or locking positions, and a retracted or unlocking position). Also FIGS. 8 and 10 show a handle lever 32, projecting at the exterior side of the door, and at the opposite side of the frame from handle 27. Handle 32 is operatively connected with the second rotary control mechanism, as is handle 27, to control latch 21 movement between extended and retracted positions, in response to manual down-turning of handle 32, at the exterior side of the door.

Latch movement between extended and retracted positions occurs in response to turning of either of handles 27 and 32 as effected via the compact secondary cam mechanism.

Figure 1:
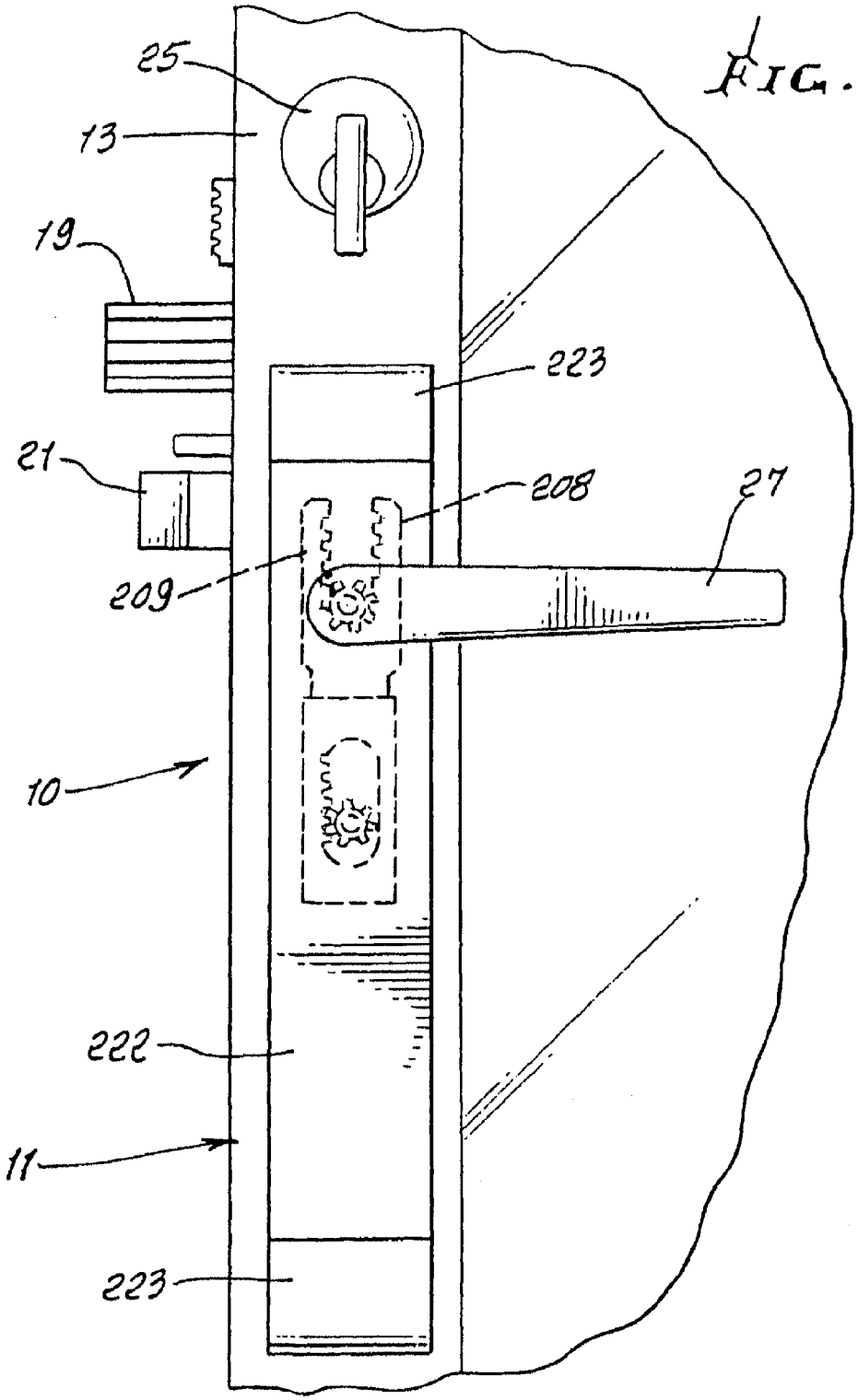
FIG. 1 is an elevation showing structure incorporating the invention.
Figure 2:
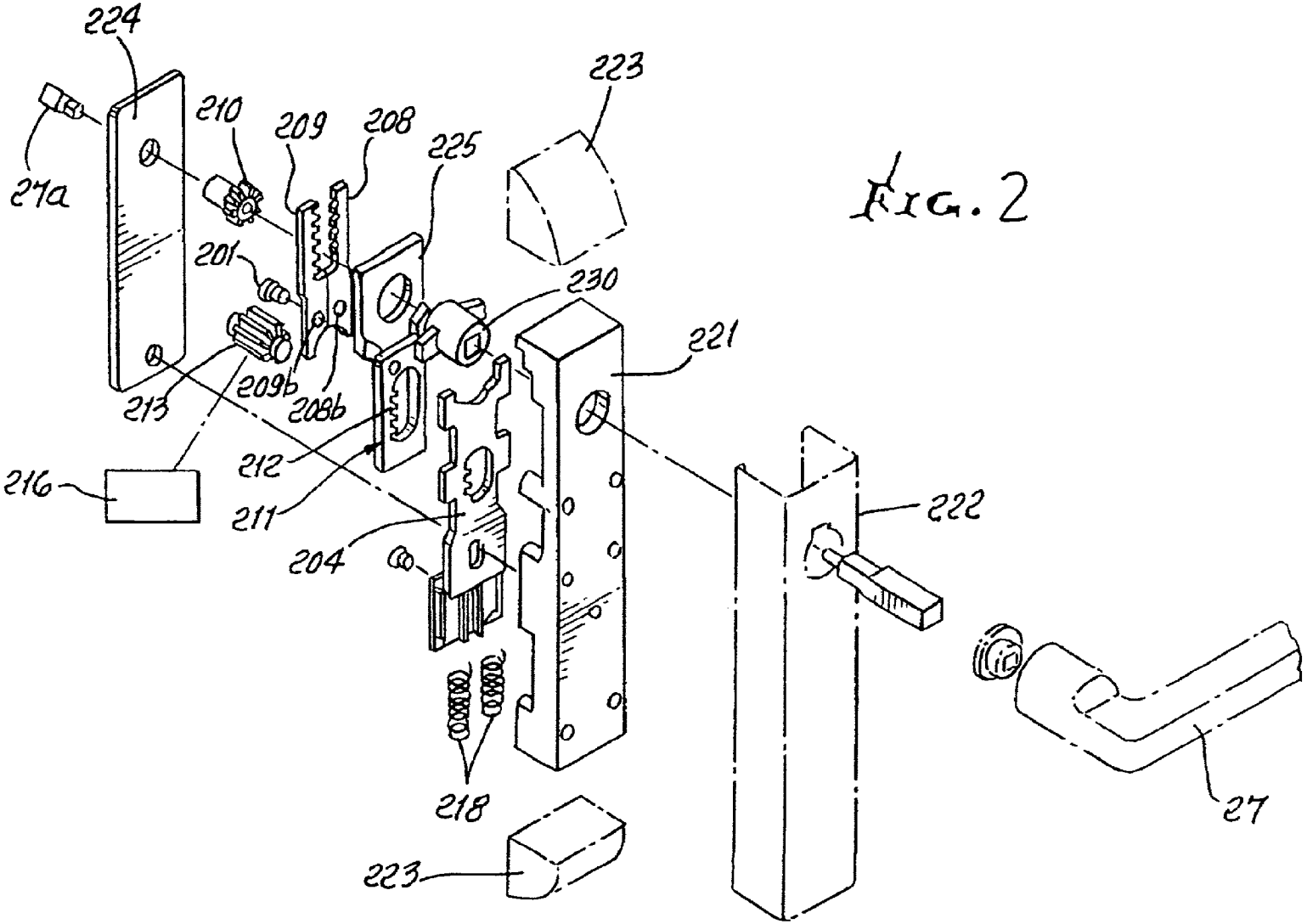
FIG. 2 is a perspective exploded view of preferred apparatus incorporating the invention.
Figure 3:
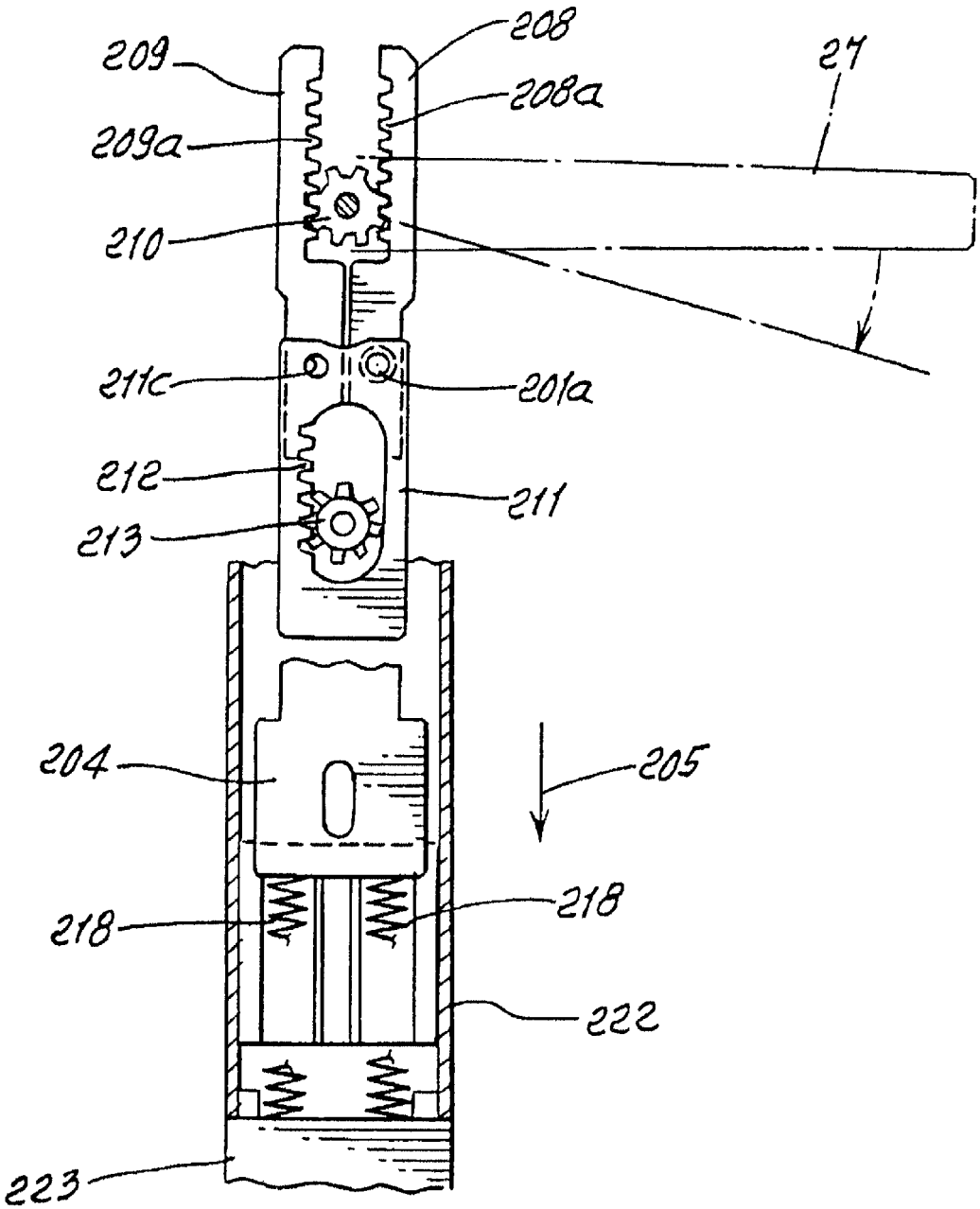
FIG. 3 is an enlarged vertical elevation showing elements including racks and gears shown in FIG. 1, and a door handle turnable clockwise to unlock the door, in response to activation of one of two parallel racks.
Figure 6:
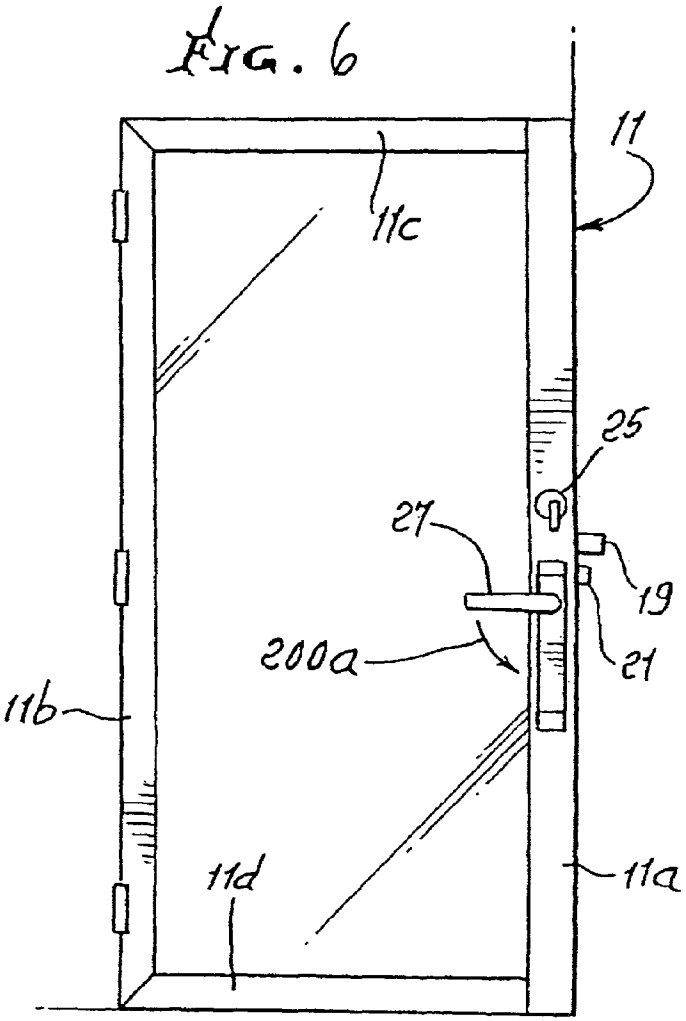
FIG. 6 shows the handle of FIG. 5 in relation to a door installation.

It is a feature of the invention that the door installation may accommodate either right-handed i.e. clockwise down movement of handle 27 (see arrow 200 in FIG. 4) to operate the latch, or left-handed i.e. counterclockwise down movement of handle 27 (see arrow 200*a* in FIG. 6) to operate the latch (i.e. retract it from a latch captivating recess in the door opening). This is accomplished with re-setting or re-positioning of only one element, such as a selector, i.e. connector pin 201 seen in FIGS. 2, 3, 5 and 7. In other words, the system enables selectively handed (right or left) handed turning of a handle for unlocking (unlatching) of a door, as at the time of door installation.

As referred to, a drive means includes handle 27 rotatable clockwise and counterclockwise; a driven means that typically includes a driven part, such as linearly movable lock actuating link plate 204, linearly movable in a primary direction (see arrow 205) to operate door lock structure; and coupling means is provided and includes the handle rotation direction selector pin 201. That pin has first and second alternate positions 201*a* and 201*b* (see FIGS. 3 and 5), whereby it operates to displace plate 204 in direction 205 in response to handle clockwise rotation (see FIG. 3) when the selector pin is in a first position, and alternatively it operates to displace 204 in the primary direction 205 in response to handle counterclockwise rotation (see FIG. 5) when the pin is in its second position.

Figure 11:
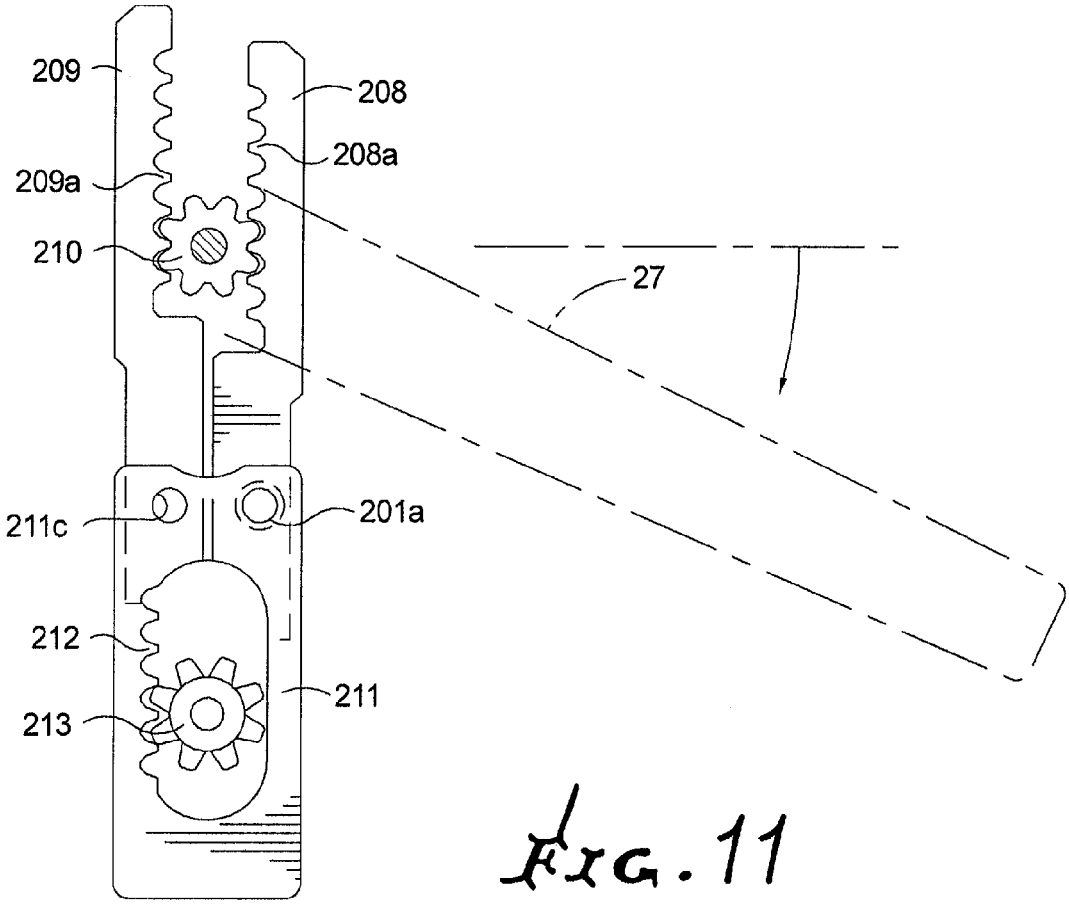
FIG. 11 is an enlarged vertical elevation showing elements including racks and gears shown in FIG. 3 when the door handle is rotated in a clockwise direction.
Figure 12:
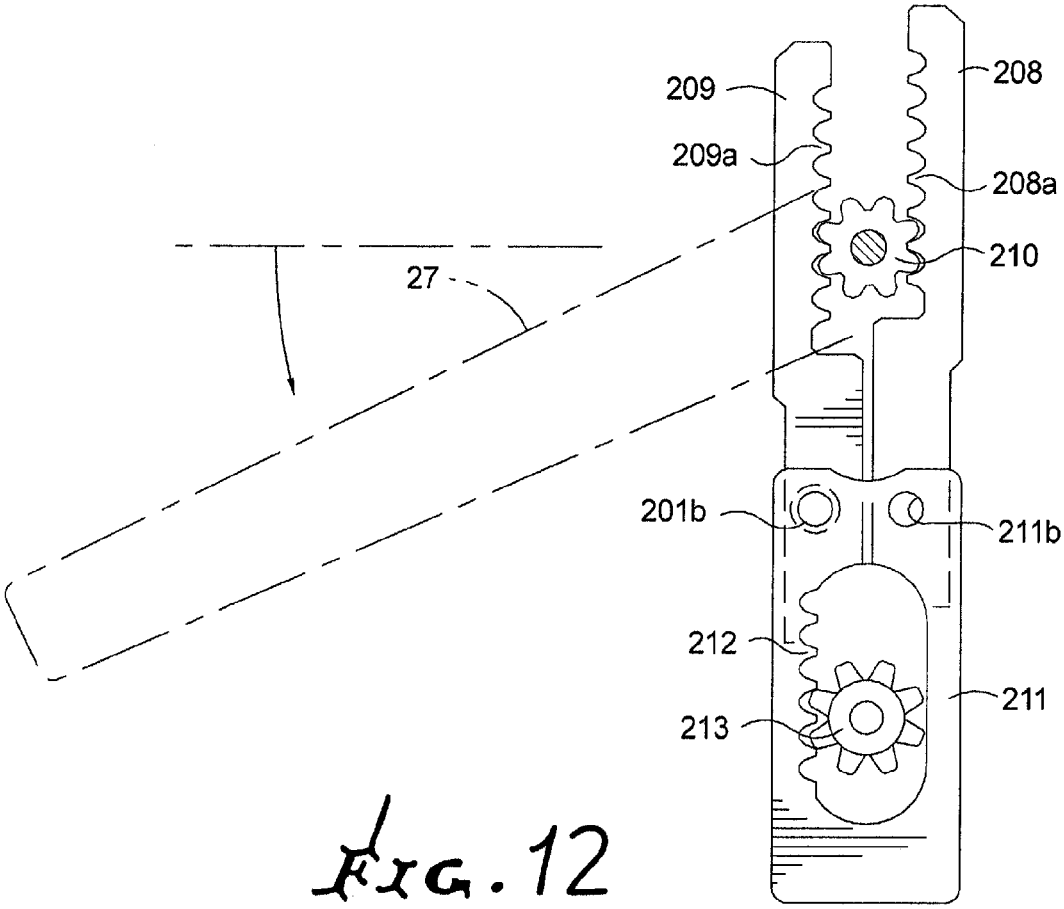
FIG. 12 is an enlarged vertical elevation showing elements including racks and gears shown in FIG. 5 when the door handle is rotated in a counter-clockwise direction.

This is accomplished in an efficient, laterally compact, and vertically longitudinally elongated or disposed positioning of elements, by providing two vertically elongated coupling racks 208 and 209, one of which is operatively coupled to the driven part 204 when the handle is turned clockwise (see FIGS. 3 and 11), and the other of which is operatively coupled to the driven part 204 when the handle is rotated counterclockwise (see FIGS. 5 and 12). Accordingly, the selector pin is alternatively coupled to one or the other of the coupling racks, in such manner that the non-coupled rack remains inactive when the coupled rack is displaced in direction 205 in response to handle rotation. Further, the noncoupled rack "floats", i.e. moves upwardly as the selector coupled rack moves downwardly. See rack teeth 208*a* and 209*a* engaging opposite sides of toothed rotary drive gear 210 rotated by handle 27 via drive cam 230. Pin is manually positioned in either FIG. 3 or FIG. 5 position, at the time of installation. It is received in drilled hole 208*b* in rack 208, and hole 211*b* in driving plate 211; or in hole 209*b* in rack 209 and hole 211*c* in driving plate 211. In either event, driving plate 211 is displaced downwardly in response to handle turning. Note driving plate 211 is coupled to link plate on member 204.

Driving plate 211 incorporates a further rack 212 operatively coupled to a driven spur gear 213, that operates door unlocking mechanism indicated at 216 as plate 204 moves downwardly. Return springs 218 serve to push plate 204 back upwardly, and its driving rack (208 or 209) back upwardly returning handle 27 to horizontal position.

The invention may be efficiently incorporated in the locking system of Ser. No. 12/383,140, that comprises a) a frame having opposite sides, and installable on a door openable between an interior space and an exterior space, b) a deadbolt and a door latch carried by the frame to move between retractable and extended positions, c) a first rotary control located at one level on the frame to control deadbolt movement between extended and retracted positions via primary cam mechanism, d) a second rotary control, operated by the handle or handles, at another level on the frame to control latch movement between extended and retracted positions, via secondary cam mechanism, e) means operatively connected between the secondary cam mechanism and the primary cam mechanism to effect deadbolt movement as aforesaid, in response to operation of the second rotary control, as effected via rotary input to the second rotary control from only one side of the frame.

Housing and mounting elements appear at 221-223 in FIGS. 1-5 and 7, along with a mounting plate 224 and a vertical displacement guide 225 for 211.

I claim:

1. A locking system enabling selective handle turning direction to operate an unlocking mechanism, comprising:

a) a handle, b) a gear, rotationally fixed to said handle, c) a first gear rack driven linearly a first direction by rotation of said handle, d) a second gear rack driven linearly in a second direction by rotation of said handle, e) a selector, and f) a driving plate with a first opening and a second opening selectively coupled to said first gear rack by said selector, wherein said selector is inserted through the first opening to selectively couple said first gear rack to said driving plate in one of a first selected position and a second selected position, wherein said driving plate moves in a first linear direction in response to handle rotation, wherein when said selector is in said first selected position to couple said driving plate to said gear rack, a rotation of said handle in a first rotational direction displaces said driving plate in said first linear direction, wherein when said selector is inserted through the second opening of the driving plate in said second selected position to couple said driving plate to said second gear rack, a rotation of said handle in a second rotational direction displaces said driving plate in said first linear direction, wherein movement of said driving plate in said first linear direction operates said unlocking mechanism, and wherein said first rotational direction is opposite of said second rotational direction.

2. The locking system of claim 1 wherein said selector comprises a pin for coupling one of the two coupling racks to said driving plate.

3. The Locking system of claim 1 further comprising a first gear driven by rotation of said handle, wherein the two coupling racks are separately movable in parallel relation, at opposite sides of said first gear.

4. The locking system of claim 1 wherein said driving plate includes a plate rack operatively coupled to a second gear, wherein rotation of said second gear operates said unlocking mechanism.

5. The locking system of claim 4 wherein the two coupling racks, and said plate rack are longitudinally oriented.

6. The locking system of claim 1 wherein, upon rotation of said handle, one coupling rack moves in a linear direction opposite to a linear direction of movement of the other coupling.

7. The locking system of claim 1 wherein gear teeth of the two coupling racks face each other.

8. The locking system of claim 1 including at least one return spring positioned to urge said driving plate in a linear direction opposite said first linear direction.

9. The locking system of claim 1 wherein said gear rack includes a first and second coupling rack, wherein said first coupling rack is moveable relative to the second coupling rack, wherein said first coupling rack, is directly coupled to said driving plate by said coupling means to move said driving plate in said first linear direction when the handle is rotated in said first rotational direction, and wherein only said second coupling rack is directly coupled to said driving plate by said coupling means to move said driving plate in said first linear direction when the handle is rotated in said second rotational direction.

* * * * *